US005277258A

United States Patent [19]

O'Dell

[11] Patent Number: 5,277,258

[45] Date of Patent: Jan. 11, 1994

[54] SINGLE LEVER BULLDOZER BLADE CONTROL APPARATUS

[76] Inventor: Jered O'Dell, Box 324, R.D. #1, Petersburg, N.Y. 12138

[21] Appl. No.: 889,169

[22] Filed: May 27, 1992

[51] Int. Cl.[5] ..... E02F 3/76

[52] U.S. Cl. ..... 172/812; 74/471 XY; 137/636.2; 172/819; 172/828

[58] Field of Search ..... 74/471XY; 137/636.2, 636.3; 37/DIG. 10; 172/812, 818, 819, 828

[56] References Cited

U.S. PATENT DOCUMENTS

| | | | |
|---|---|---|---|
| 3,131,574 | 5/1964 | Clingerman | 137/636.3 |
| 3,321,990 | 5/1967 | Densmore | 74/471 XY |
| 3,700,044 | 10/1972 | Berg | 172/804 |
| 3,747,472 | 7/1973 | Knutson | 91/384 |
| 3,795,280 | 3/1974 | Casey | 172/804 |
| 3,854,380 | 12/1974 | Casey | 91/413 |
| 3,993,175 | 11/1976 | Beveridge | 74/471 XY |
| 4,187,737 | 2/1980 | Mori et al. | 74/471 XY |
| 4,283,964 | 8/1981 | Grattapaglia | 74/471 XY |
| 4,671,378 | 6/1987 | Korrect et al. | 74/471 XY |
| 4,938,091 | 7/1990 | Waggoner et al. | 74/471 XY |
| 4,978,273 | 12/1990 | Radke et al. | 74/471 XY |
| 5,112,184 | 5/1992 | Tapper et al. | 74/471 XY |

*Primary Examiner*—Randolph A. Reese
*Assistant Examiner*—Spencer Warnick
*Attorney, Agent, or Firm*—William B. Ritchie

[57] ABSTRACT

A single lever blade control apparatus for bulldozers that is capable of operating in three mutually perpendicular planes to activate three independent hydraulic valves controlling a bulldozer blade: up/down, tilt and angle. Movement of the bulldozer blade in an up/down motion is accomplished by the operator by pushing the single lever apparatus in the X direction, the X direction corresponding to the longitudinal axis of the bulldozer. Movement of the bulldozer blade in the tilt direction is accomplished by the operator pushing the single lever apparatus in the Y direction. Angling the bulldozer blade is accomplished by the operator rotating the handle of the single lever apparatus about the Z axis. The invention works with all variations of hydraulic valve placement.

5 Claims, 4 Drawing Sheets

FIG. 3
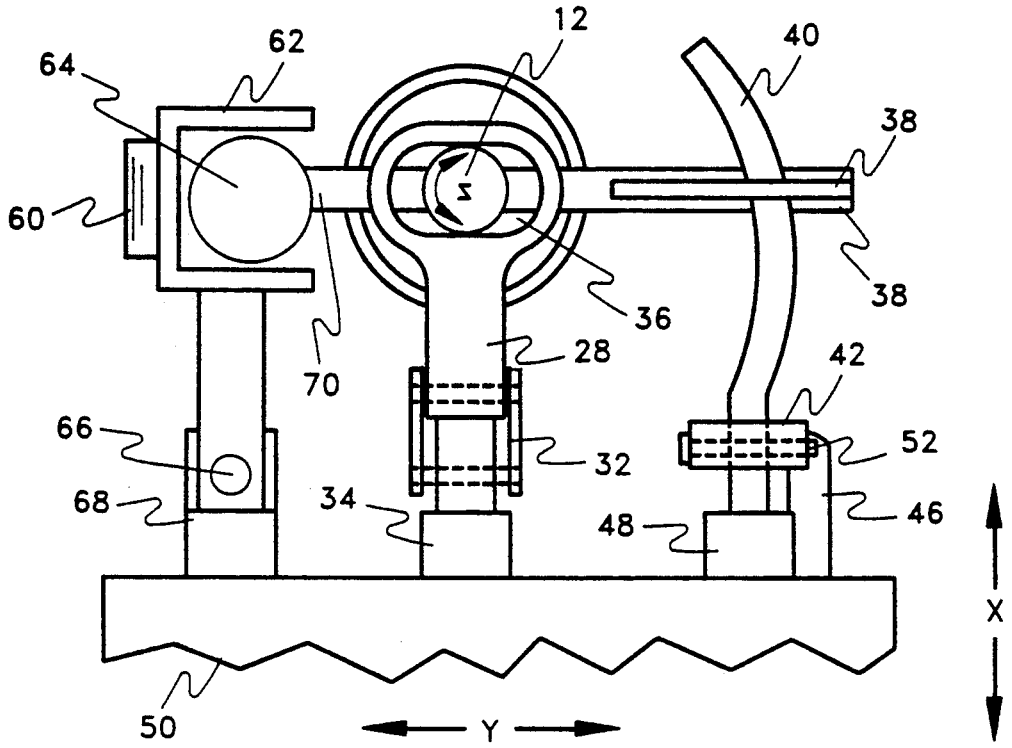
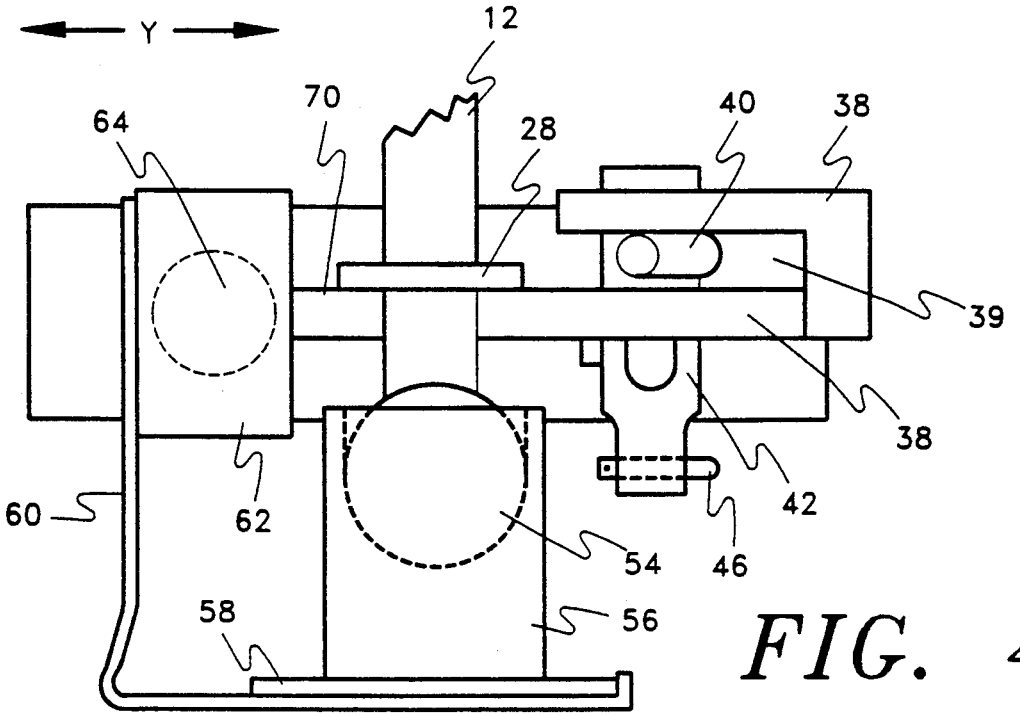
FIG. 4

SINGLE LEVER BULLDOZER BLADE CONTROL APPARATUS

BACKGROUND OF THE INVENTION

1. Field of the Invention

The invention relates to bulldozer blade control mechanisms.

2. Description of the Related Art

A bulldozer blade is generally mounted on the chassis of the vehicle so that it can be actuated by hydraulic cylinders in at least three distinct motions: blade tilt, up and down, and blade angle. In the largest bulldozers, blade pitch is also a controllable motion. Simplified versions of hand operated control mechanisms to accomplish these hydraulically actuated motions has been sought after for quite a while.

U.S. Pat. No. 3,700,044, issued to Berg, discloses a single lever control which pivots on two axes to control the pitch (e.g. the upper portion of the blade is moved fore or aft relative to the lower portion of the blade) and tilt (raising one end of the blade relative to the other end). Berg teaches that angling (moving one end of the blade forward relative the other end) is best accomplished by a separate lever.

U.S. Pat. Nos. 3,795,280 and 3,854,380, issued to Casey, disclose what is described as "a three-way lever control" for hydraulic control valves. However, the "lever" is able to control only two valves; the third is controlled by a second lever arm, attached to the "lever" which actuates a solenoid switch. It is clear that this "lever" is capable of operating only in two distinct planes, x and y.

U.S. Pat. No. 3,747,472, issued to Knutson, discloses the advantages offered by a system that can actuate three hydraulic controls by a single lever. However, rather provide a mechanical linkage that accomplishes the task, Knutson requires a complicated force amplifier system using push pull cables. The use of this complex system results in extra cost and reduced reliability.

A single lever blade control apparatus that is capable of operating in three mutually perpendicular planes to activate three independent hydraulic valves controlling a bulldozer blade is not found in the prior art.

SUMMARY OF THE INVENTION

It is object of the invention to provide a single lever blade control apparatus that activates three independent hydraulic control valves by direct mechanical linkage without the use of cables.

It is still another object of the invention to provide a single lever blade control apparatus that controls the blade through hand motions that match the motion of the blade, i.e., moving the hand to the right moves the blade to the right.

It is still another object of the invention to provide a single lever blade control apparatus that is adaptable for most bulldozers.

It is another object of the invention to provide a single lever blade control apparatus that will control one, two or three hydraulic valves simultaneously depending on the single hand motion made by the operator.

It is a final object of the invention to provide a single lever blade control apparatus that is capable of operating in x and y planes and rotation about the z axis to activate three independent functions of a bulldozer blade.

The invention is a single lever blade control apparatus for actuating three separate hydraulic control valves controlling the blade of a bulldozer by a single coordinated motion of an operator's hand. A single lever movable along X and Y axis is provided. The single lever has a movable handle rotatable around a Z axis, with X, Y and Z axes mutually perpendicular to one another. First linkage means connected to said lever for actuating the first hydraulic valve to control the up and down movement of said blade when said lever is moved along the x axis is provided. Second linkage means connected to said lever for actuating the second hydraulic valve to control the tilt of said blade when said lever is moved along the y axis is provided. Third linkage means connected to said lever for actuating the third hydraulic valve to control the angle of said blade when the handle of said lever is rotated around the z axis is provided.

BRIEF DESCRIPTION OF THE DRAWINGS

FIG. 3 is a top view of the mechanical linkage connecting the single lever to three hydraulic valves in accordance with the invention.

FIG. 4 is a front view of the mechanical linkage of the single lever control apparatus.

DETAILED DESCRIPTION OF THE INVENTION

Figure 1:
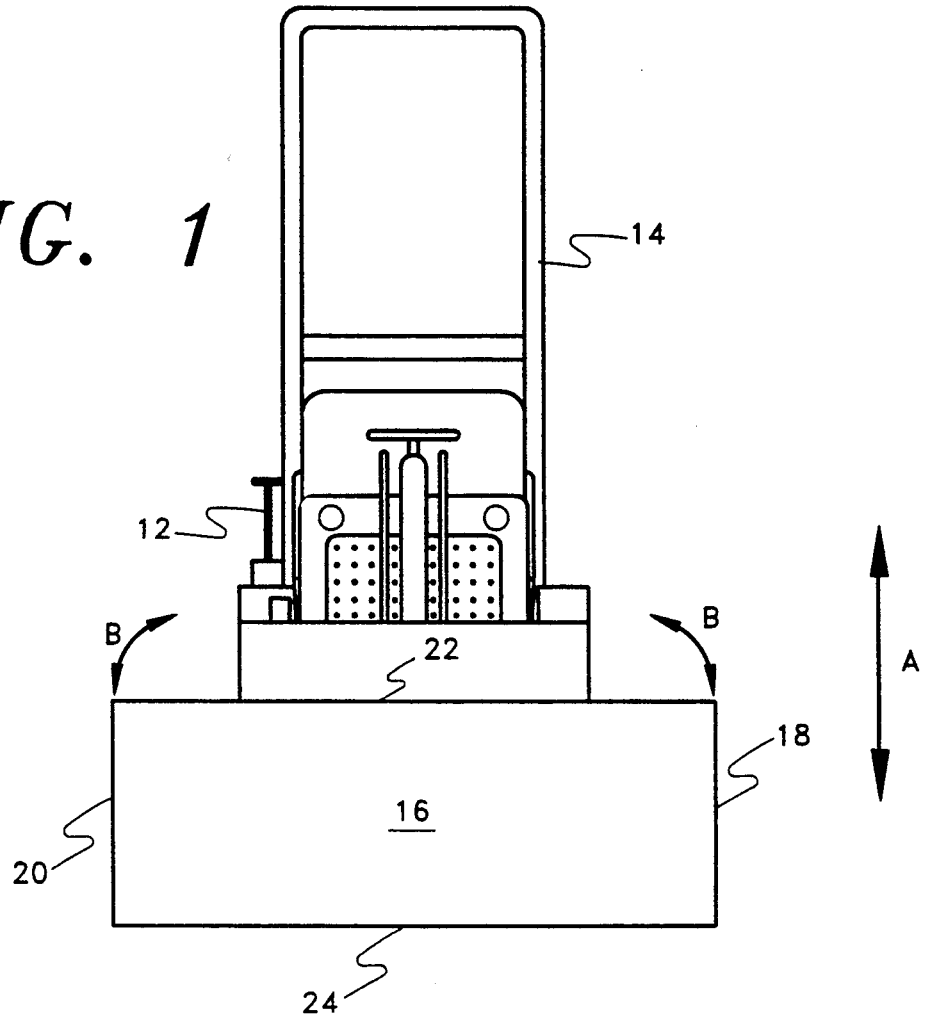
FIG. 1 is a front view of a bulldozer with the single lever blade control apparatus in accordance with the invention.

FIG. 1 is a front view of a bulldozer 14, in this case the JERI-TRAC TM, with the invention in place. Single lever 12 is shown in typical position on the right side of the operator's seat. Note that all reference to direction are from the operator's perspective when seated on bulldozer 14.

Several distinct motions of blade 16 are required for bulldozer 14 to efficiently perform useful work such as grading, leveling, backfilling, and ditching.

First, the blade 16 must be able to be raised and lowered as shown by arrow A. For light grading activities, this motion is sufficient.

For the largest bulldozers, it is desirable for the blade to "pitch" about an axis parallel to the longitudinal axis of the blade. That is, blade top 22 of blade 16 must be moveable forward and rearward with respect to blade bottom 24 of blade 16.

Another motion that is particularly useful for excavating operations is usually referred to as "tilt". Tilt is where blade 16 rotates in a plane perpendicular to the longitudinal axis of the dozer 14, moving along arrows B. This movement results one end of blade 16 being higher than the other.

It is also desirable to be able to angle the blade 16, that is, rotate blade 16 about its vertical axis. This results in one blade end being further forward than the other, thus, being able to push material to one side, snowplow fashion.

With the invention describe herein, three of those motions can be simultaneously controlled by single lever 12, either separately or simultaneously in combination with one another for coordinated control of blade 16.

Figure 2:
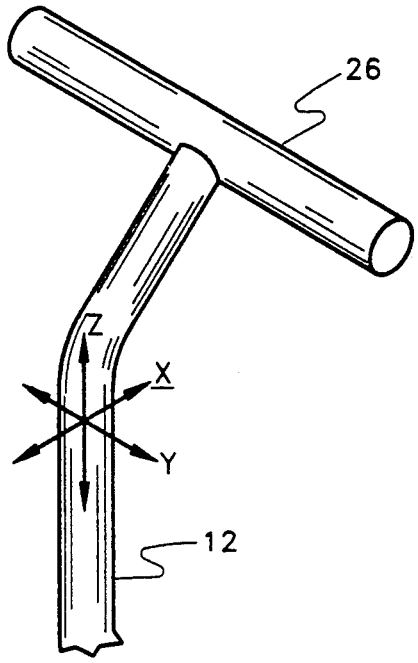
FIG. 2 is an isometric view of the single lever showing the three axes of movement.

FIG. 2 is an isometric view of the single lever 12 showing the three axes of movement that actuate hydraulic valves through mechanical linkage attached to the lever 12. Pushing on handle 26 causes lever 12 to be activated along the x-axis which results in blade 16 being lowered. Likewise, pulling on handle 26 causes lever 12 to again be activated along the x-axis with blade 16 now moving upwards. While the invention as featured on dozer 14 causes up/down motion for this movement, alternatively, x-axis motion of lever 12 could be actuated to cause blade 16 to pitch as discussed above.

Tilting lever 12 to the right, thus, moving along the y-axis, results in blade 16 to be tilted toward the right. That is, Blade end 20 is lower than blade end 18. Tilting lever 12 to the left, again, moving the y-axis, results in blade 16 being tilted toward the left, that is, blade end 18 being lower than blade end 20.

Finally, rotating handle 26 about the Z-axis in a clockwise direction, causes blade 16 to be angled towards the right, while rotating handle 26 about the Z-axis in a counterclockwise direction causes blade 16 to be angled towards the left.

Moving the lever 12 and handle 26 in all three directions simultaneously causes each hydraulic valve to be activated accordingly, thus giving precise control of blade 16 with a single compound motion of one hand.

FIGS. 3 and 4 show a top view and front view, respectively, of the mechanical linkage connecting the single lever to three hydraulic valves in accordance with the invention. When lever 12 is moved forward in the X direction, as shown by the arrows, force is transmitted through loop lever 28 to blade vertical position valve 34, thus causing valve 34 to open and blade 16 to move downward. Loop lever 28 is flexibly connected to valve 34 through #40 roller chain 32.

When lever 12 is moved backward in the X direction, valve 34 is thus closed, causing blade 16 to move upward.

Note that lever 12 can be moved in the Y direction without causing unwanted motion in the X direction since loop lever 28 is connected to valve 34 with flexible chain 32. Also, note that loop lever 28 is connected to lever 12 via slot 36. Slot 36 is dimensioned so that its axis that is coextensive with the Y direction is substantially greater than the diameter of lever 12 while its axis that is substantially perpendicular to the Y direction, that is, the X direction, is close to the diameter of lever 12. This assists in having motion in the Y direction without necessarily causing a corresponding activation in the X direction.

Figure 5:
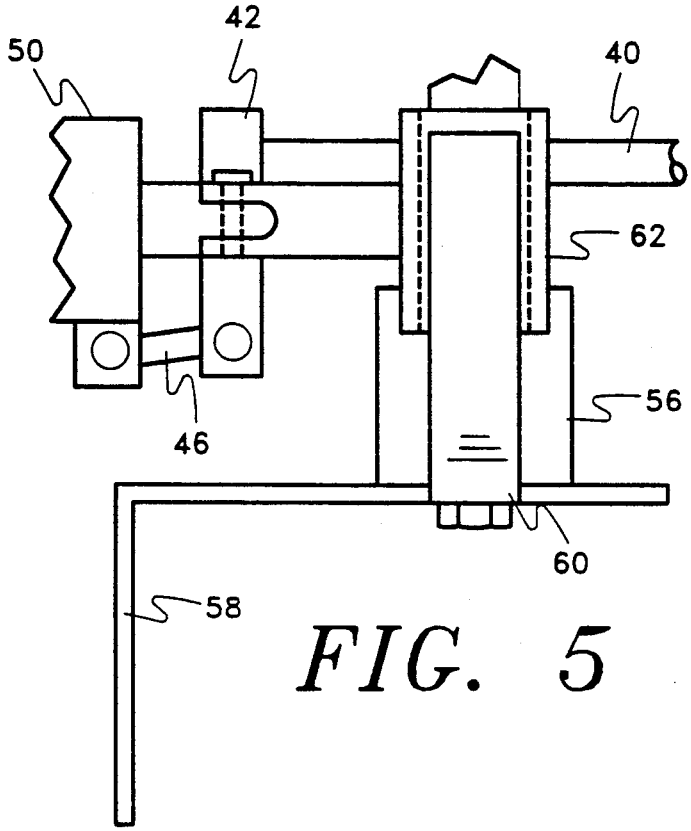
FIG. 5 is a right view of the mechanical linkage of the single lever control apparatus.
Figure 6:
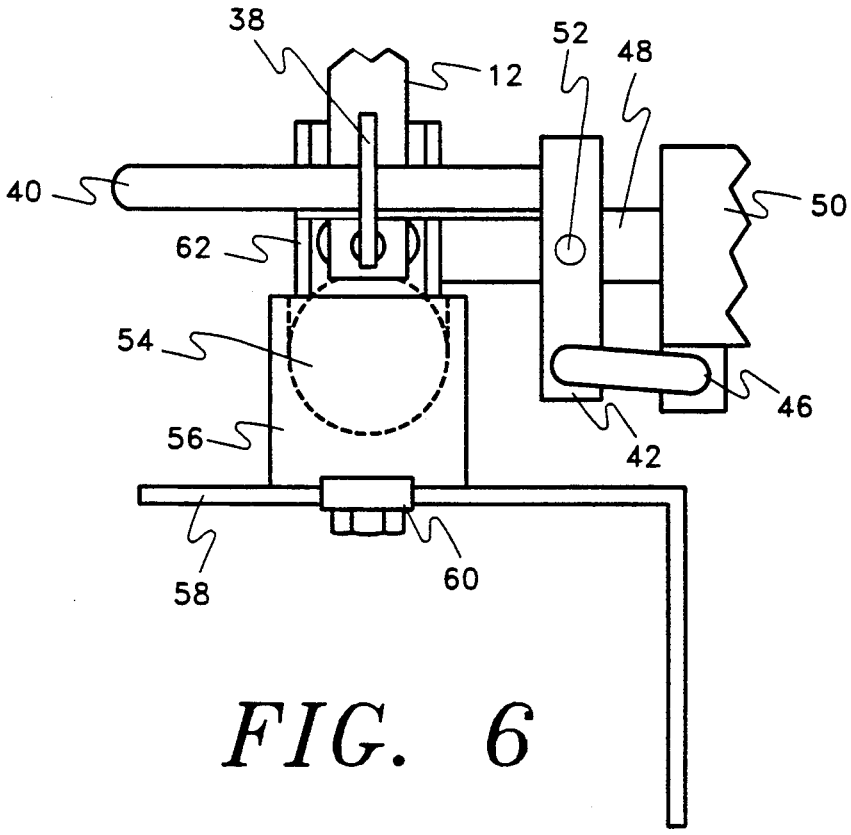
FIG. 6 is a left view of the mechanical linkage of the single lever control apparatus.

Referring now to FIG. 3, tilting lever 12 to the left, that is, along direction Y, actuates valve selector valve 48. As shown, tilt bar 40 is inserted in slot 39 formed by U-shaped tilt lever 38. Tilt lever 38 is shown as comprising two sections, however, tilt lever 38 could also be fabricated from a single section. Tilt bar 40 is shown as curved, however, the inventor has found that a straight bar is basically equivalent. Tilt bar 40 is connected to tilt beam 42 via pin 52. Beam 42 is pivotly attached to valve body 50 (shown in FIG. 5) so that pushing down bar 40, that is, when lever 12 is moved to the left along direction Y, causes beam 42 to move outward. In turn, beam 42 moving outward, pulls tilt valve 48 outward, thus opening the valve and causing blade 16 to tilt left. Moving lever 12 to the right, as shown in FIG. 3, causes tilt lever 38 to push up tilt bar 40 which in turn causes beam 42 to move inward, thus opening the valve in the opposite direction and causing blade 16 to tilt to the right.

Note that lever 12 is attached to base 58 via ball 54 and socket 56 which enables lever 12 infinite adjustability over the range of motion required for all three axes.

Rotating handle 26, thus causing lever 12 to rotate around the Z axis, actuates the hydraulic valve responsible for angling blade 16. Spring 60 keeps angle ball 64 within cup angle lever 62 when lever 12 is moved in the Y direction.

Rotating handle 26 to the left, or counterclockwise, forces angle ball 64 against cup angle lever 62. This pulls pin 66 which results in angle valve 68 opening and causing blade 16 to angle to the left. Twisting handle 26 to the right, causes the opposite effect, and blade 16 will then angle to the right. Angle ball 64, preferably nylon, is able to rotate on angle rod 70. Angle rod 70, preferably steel, is welded to lever 12 as shown in FIG. 4. Only a small movement of lever 12 and handle 26 is required to cause valves 34, 48, 68 to open fully. The inventor has found that about ¼ inch is required for small valves white ½ inch of movement is required for large valves. Valve control in the X axis is rather tight whereas the movement in the Z axis has just enough freedom (preferably approximately one hundred thousands of an inch) to prevent interference with the up/down actuation of the blade 16. This allows a very slight twisting of handle 26 before angle ball 64 engages angle lever 62 of handle 26 required before activating valve 68.

Figure 7:
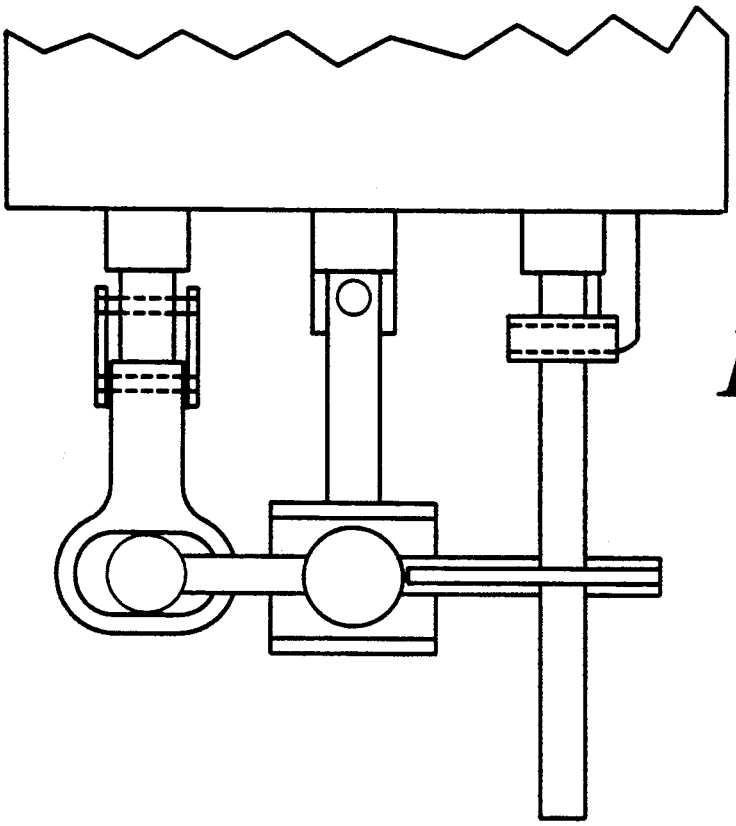
FIG. 7 is a top view of an alternative embodiment of the invention.

Note that the placement of three valves have been shown in a horizontal position with the up/down valve in the center, the angle valve on the right, and the tilt valve on the left. This is the preferable position. However, some selector valves contain an internal float mechanism (not shown) which is not always in the same valve spool but must be hooked up to the mechanism responsible for up/down activation. The float mechanism cancels all pressure to the up/down cylinder so that the blade weight will follow the ground surface, thereby smoothing the surface. Therefore, it may be desirable to have a different placement. The inventor has found that all other combinations would also work. FIG. 7 shows a top view of an alternative arrangement of the valve, again in a horizontal position. In this embodiment, the up/down valve is on the left, the tilt valve remains on the right, and angle valve is now in the center. The operation of the linkage is exactly the same as previously discussed and all six combinations of placement of the respective valves work.

Figure 8:
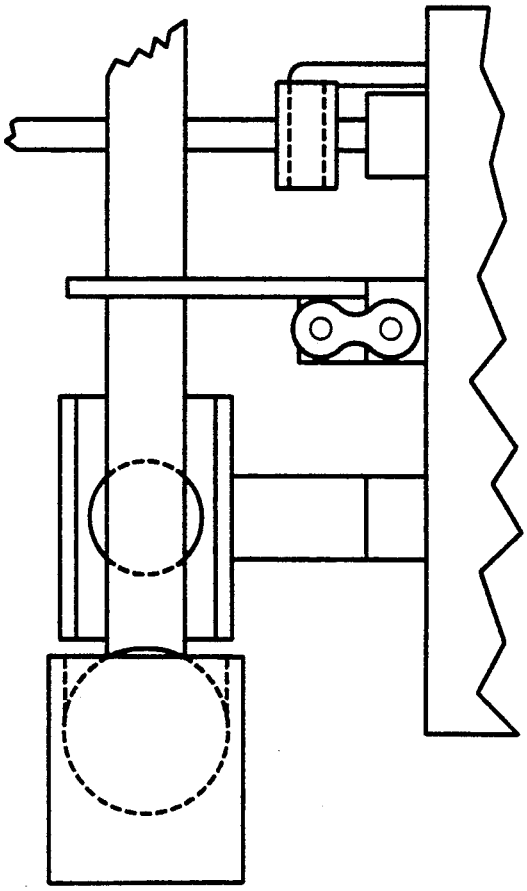
FIG. 8 is a front view of another alternative embodiment of the invention.

In FIG. 8, the arrangement of valves is shown in a vertical position, with the tilt valve at the top, the up/-down valve in the center, and the angle valve at the bottom. Again, all six possible vertical arrangements of the three types of linkages work.

The parts described herein can easily be manufactured in any standard machine shop. The size of the parts depends on the size of the selector valve chosen. Some valve spools are 1¼ inches apart; others are 1¾ inches apart. The inventor has found that the system works equally as well on either size.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A single lever blade control apparatus for actuating three separate hydraulic control valves controlling the blade of a bulldozer by a single coordinated motion of an operator's hand comprising:

a single lever movable along X and Y axes, and having a movable handle rotatable around a Z axis, with X, Y and Z axes mutually perpendicular to one another;

first linkage means connected to said lever for actuating the first hydraulic valve to control the up and down movement of said blade when said lever is moved along the X axis; wherein said first linkage means further comprises a first member with a slot through which said lever is placed, with said slot having a dimension, corresponding to the Y axis that is substantially greater than its dimension corresponding to the X axis, and with said first member connected to said first hydraulic valve by a roller chain link;

second linkage means connected to said lever for actuating the second hydraulic valve to control the tilt of said blade when said lever is moved along the X axis; wherein said second linkage means further comprises a second member attached to said lever, with said second member having a slot through which an arcuate member is placed, and having said arcuate member pivotly attached to said second hydraulic valve wherein movement of said lever along the Y axis causes said second member to move said arcuate member, thereby actuating said second valve;

third linkage means connected to said lever for actuating the third hydraulic valve to control the angle of said blade when the handle of said lever is rotated around the Z axis.

2. The single blade control apparatus of claim 1 wherein said hydraulic valves are located in substantially the same horizontal plane.

3. The single blade control apparatus of claim 1 wherein said hydraulic valves are located in substantially the same vertical plane.

4. The single blade control apparatus of claim 1 wherein said third linkage means further comprises a ball and cup member associated with said lever, with said cup member attached to said third hydraulic valve, wherein rotating said handle of said lever about the Z axis causes said ball to be urged against said cup member, thereby actuating said third valve.

5. The single blade control apparatus of claim 4 wherein said lever is attached to said bulldozer by a ball and socket joint.

* * * * *